United States Patent [19]

Tuskos

[11] Patent Number: 4,586,447

[45] Date of Patent: May 6, 1986

[54] SEWING MACHINE NEEDLE POSITIONER

[76] Inventor: Michael Tuskos, 5719 W. Highway 22, Crestwood, Ky. 40014

[21] Appl. No.: 582,313

[22] Filed: Feb. 22, 1984

Related U.S. Application Data

[63] Continuation-in-part of Ser. No. 337,619, Jan. 7, 1982, abandoned.

[51] Int. Cl.[4] ..... D05B 69/22

[52] U.S. Cl. ..... 112/274

[58] Field of Search ..... 112/274

[56] References Cited

U.S. PATENT DOCUMENTS

| | | | |
|---|---|---|---|
| 3,439,638 | 4/1969 | Zuk | 112/274 |
| 4,073,250 | 2/1978 | Kasuga | 112/274 |
| 4,380,962 | 4/1983 | Touret | 112/274 |
| 4,414,909 | 11/1983 | Bray | 112/274 |
| 4,423,692 | 1/1984 | Kelly et al. | 112/274 |
| 4,438,718 | 3/1984 | Hanyu | 112/274 |

*Primary Examiner*—Werner H. Schroeder

*Assistant Examiner*—Andrew M. Falik

[57] ABSTRACT

Sewing machine needle positioning devices to position a sewing machine needle to selected location with respect to a work surface where the sewing machine includes a rotatable drive shaft to drive the needle and stitching mechanism. A clutch wheel is attached to the drive shaft to rotate the drive shaft when the clutch is rotated in a first direction. A cam is located on a drive shaft extension to engage a cooperative pressure plate carried by a gear rack assembly which is moved bidirectionally along a selected axis to engage a gear carried by the clutch to rotate the shaft in the first direction where the gear rack moves in one linear direction until the cam engages the pressure plate to stop the machine when the clutch has rotated it in the first direction to a selected position where the needle is in selected location with respect to the work surface. The clutch is then rotated by said gear in a second direction when the gear rack moves in the second linear direction to remove the pressure plate from the cam.

6 Claims, 12 Drawing Figures

1
21
4
18
20
26
5
19
14
13
7
8
9
12

SEWING MACHINE NEEDLE POSITIONER

BACKGROUND OF THE INVENTION

The present invention is a continuation in part of my copending application Ser. No. 337,619 abandoned filed Jan. 7, 1982 relates to apparatus and means for selectively and accurately positioning the needle assembly of a sewing machine after the machine has been stopped.

In many cases, it is important for the machine to be stopped at a position where the needle is located out of the work. Such machines are conventionally operated by actuation of a treadle, for example, and as long as the operator maintains the treadle depressed, the machine will continue to operate in a normal way. When a given operation is completed the operator simply releases the treadle, to stop the machine. It may happen that the machine will come to rest with the needle out of the work. It also happens that the machine comes to rest with the needle extending into the work. In many cases, for example where the work is to be removed from the machine, it is necessary for the operator to manually actuate the machine until the needle is in a position where the needle is out of the work.

The latter requirement of a manual operation is an inconvenience in the operation of the machine and furthermore results in a loss of time and thus undesirably increases the costs of the operation of the machine.

In other cases it is desirable for the needle to be positioned through the work after the operation has ceased, for example when the work is to be turned without breaking the stitch.

The need for means to accurately position a needle of a sewing machine, at the end of a period of operation, particularly in position out of the material, is discussed in various prior art disclosures. For example, in Leveque U.S. Pat. No. 1,953,965; Bilgen U.S. Pat. No. 2,277,475 and Beno U.S. Pat. No. 3,077,845 teach devices to stop the machine with the needle out of the work material. However, these prior art devices are an integral part of the sewing machine.

U.S. Pat. No. 3,534,845 teaches a device to selectively stop the needle at a selected position above the work material where the device can be connected to conventional machines.

The foregoing appear to represent a class of devices where the machine is stopped only when the needle is in the selected position. Such arrangements while they may satisfactorily stop the needle in the selected position can introduce damaging strains and stresses in the drive system of the machine because the drive train is abruptly stopped when the treadle is released and the needle reaches the selected position Zuk U.S. Pat. No. 3,439,638 teaches a needle positioner which can be mounted to a conventional sewing machine to position the needle in the "up" or "down" position after the treadle is released. However the Zuk reference utilizes a strap connected to an extension of a drive shaft of the sewing machine which requires expensive complex guide means as well as shifting mechanisms for shifting the strap. Additionally, the procedure for adjusting the device to properly position the needle is quite complex.

SUMMARY OF THE INVENTION

The present invention provides an economical straightforward arrangement for positioning a needle of a sewing machine after the operation of the sewing machine has been terminated.

Advantageously means can be provided to selectively position the needle in the up or down position or both by utilization of dual devices.

Moreover devices within the scope of the present invention can be easily adjusted so that the same device can be utilized to position the needle in the up or down position by simple adjustment of the position the cam on the drive shaft extension of the machine.

More particularly, the present invention provides a device for use with a sewing machine to position the sewing machine needle to selected location with respect to a work surface where the sewing machine includes a rotatable drive shaft for the stitching mechanism. The invention provides an extension with cam attached to the drive shaft to rotate the drive shaft when the clutch is rotated in a first direction. A cam stop is provided on the shaft extension to engage a pressure plate when the clutch has rotated in the first direction to a selected point where the needle is in selected location with respect to the work surface. The pressure plate is carried by a gear rack assembly which moves bidirectionally along a selected axis to engage a gear carring the clutch to rotate the shaft extension in the first direction where the gear rack moves in one linear direction until the cam engages the pressure plate to stop the machine then the gear rack assembly rotates the gear with the clutch in the second direction when the gear rack moves in the second linear direction will remove the pressure plate from the cam thus alowing the shaft to rotate free.

It will be understood that the following is but one example of an arrangement within the scope of the present invention and other arrangements also within the scope of the present invention will occur to those skilled in the art upon reading the disclosure set forth hereinafter.

BRIEF DESCRIPTION OF THE DRAWINGS

Referring now to the Figures which show one arrangement within the scope of the present invention:

FIGS. 3A–3B illustrate a clutch and gear as well as a stop assembly as shown in FIG. 2;

FIG. 8 is an illustration of another feature of an example of the present invention.

DETAILED DESCRIPTION OF THE DRAWINGS

Figure 1:
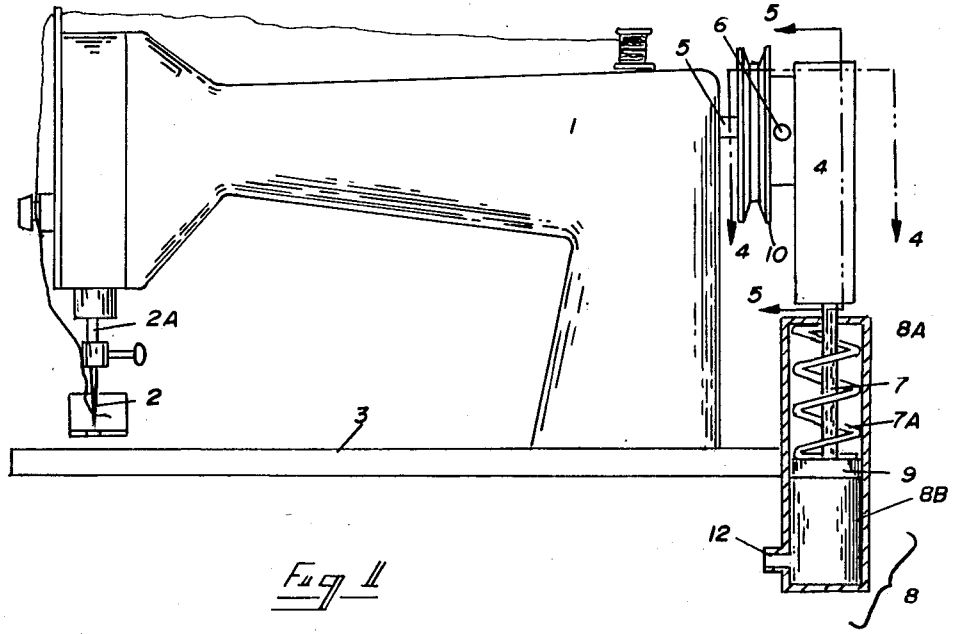
FIG. 1 is an elevational view of a sewing machine from the operators side thereof with a device in accordance with the present invention attached thereto.

Referring to FIG. 1 the reference numeral 1 designates a substantially conventional sewing machine to which the positioning attachment 4 within the scope of present invention, is attached. The sewing machine 1 includes the conventional horizontally located shaft 5 which through a suitable pulley 10 is belt driven from a motor (not shown) positioned beneath table top 3 of the machine 1. As is known in the art the operation of the sewing machine commences and closes as the operator actuates and deactuates the motor. Shaft 5 in turn drives a vertically reciprocating shaft 2A upon which needle assembly 2 is mounted. In the arrangement shown the conventional hand wheel (not shown) has been eliminated. However it will be understood that if desired the hand wheel could be placed on the shaft 5 outside the assembly 4 as described hereinafter.

Figure 3A:
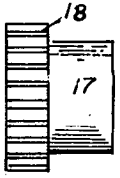
Figure 3A:
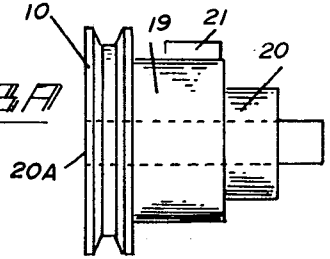
Figure 2:
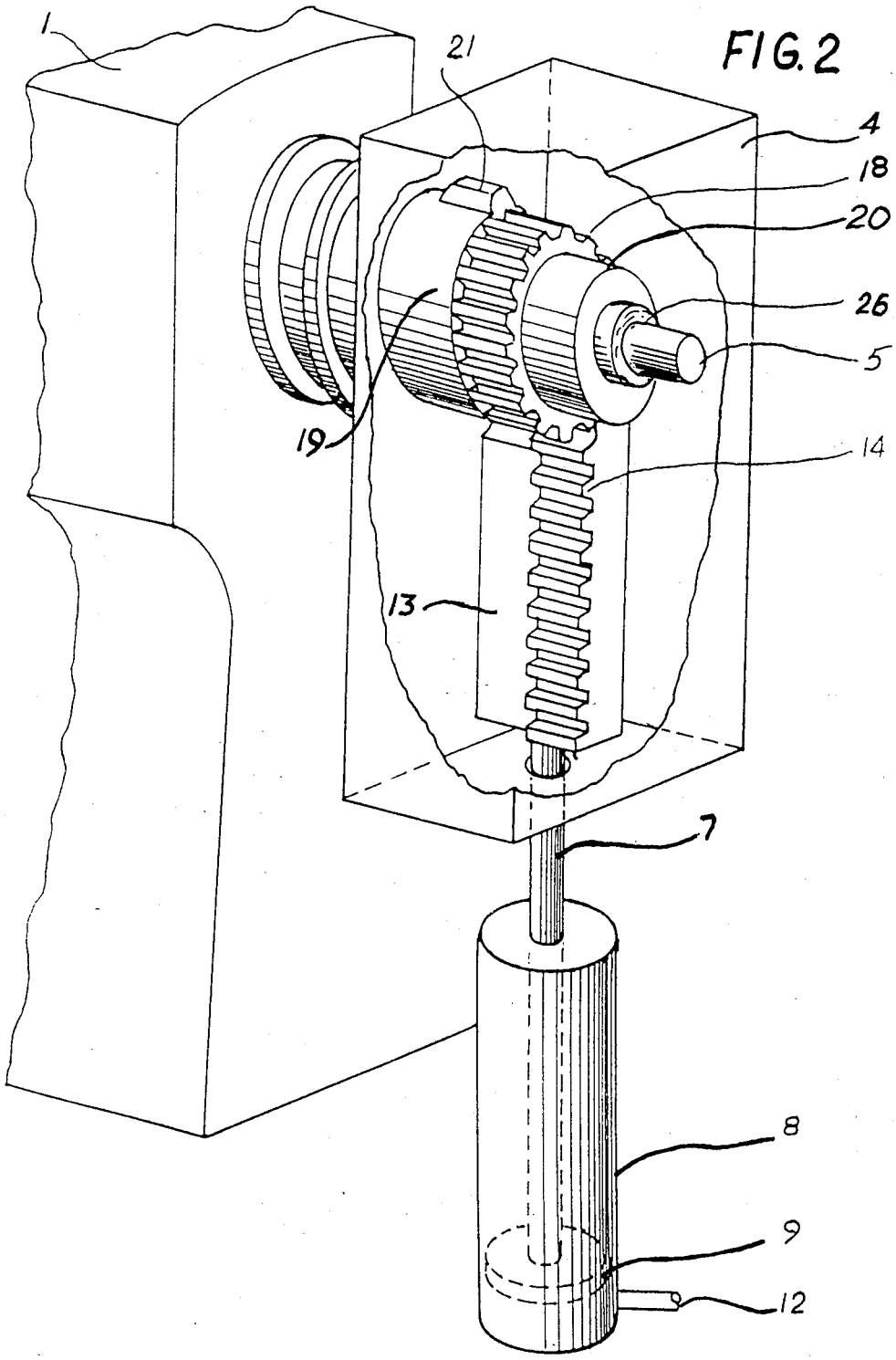
FIG. 2 is a perspective view, in section, of an example of a device within the scope of the present invention in assembled form on the sewing machine of FIG. 1.

As shown in FIG. 2 which shows device 4, in section, a cam wheel 19 is provided to carry a cam 21. Wheel 19 also includes a clutch assembly 20 as also shown in FIG. 3A. Pulley 10 can be carried by cam wheel 19 as shown in FIG. 3A to receive drive belt (not shown) to drive the sewing machine. Clutch 20 is located outwardly from the base of wheel 19 and a central aperture 20A is provided to receive shaft 5 which is turned by pulley 19. A threaded aperture 6 is provided to receive a set screw (not shown) to secure the assembly to shaft 5.

A gear wheel 18 is provided and includes; central aperture (not shown) to receive the clutch 20 as is known in the art. It will be understood that clutch 20 is adapted to engage rotatable cam wheel 19 and shaft 5 in one direction in response to movement of a gear rack 14 in one direction, and to permit free movement of gear wheel 18 on clutch 20 in the opposite direction without rotation of wheel 19 as described hereinafter.

Figure 4:
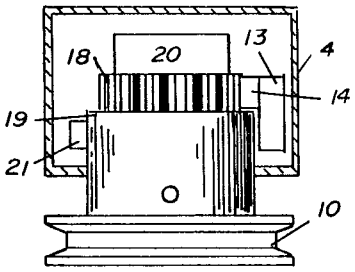
FIG. 4 is a view taken along a plane passing through line 4—4 of FIG. 1.
Figure 5:
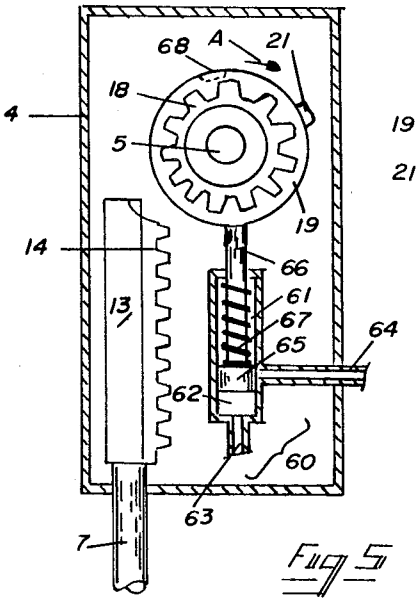
FIG. 5 is a view taken along a plane passing through line 5—5 of FIG. 1.
Figure 4:
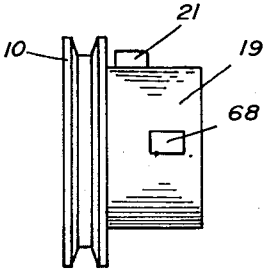

More particularly, it will be understood that in the assembly shown in FIGS. 3A, 3B and 5 movement of gear 18 in one direction will rotate the body of clutch 20 and cam wheel 19 to rotate shaft 5 while rotation of gear 18 in the opposite direction will result in no movement of cam wheel 19. An elevational view of another arrangement within the present invention is shown in FIG. 5.

As further illustrated in the FIG. 1, an acutating means 8 is provided to operate the device including a casing 8A adapted to receive a shaft 7 carried by rack 14 to move longitudinally within casing 8A. A plunger 9 is provided adjacent one end of shaft 7 in casing A where a chamber 8B is provided on the side of plunger 9 opposite a spring 7A which is located within casing 8A to hold shaft 7, and rack 14, in the example shown, in a down position with rack 14 out of engagement with gear wheel 18 of clutch 17.

Figure 6A:
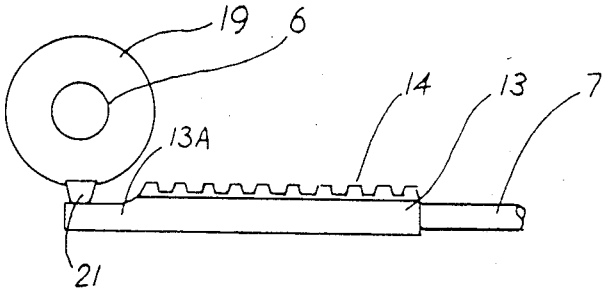
FIGS. 6A–6B are schematic illustrations of sequential operation of a device within the scope of the present invention.
Figure 6B:
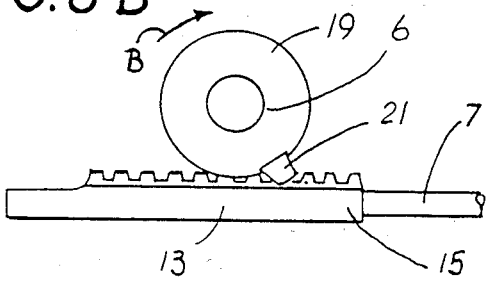

A fluid inlet 12 is provided for admission of pressurized fluid to chamber **8*b* to move plunger 9 and shaft 7 upwardly so that gear rack 14 engages gear wheel 18 to rotate wheel 19 and stop 21 in the selected direction as shown by arrow A, and further illustrated in FIGS. 6A and 6B**.

Referring to FIG. 6A which is a schematic illustration of the operation of the device shown in the preceeding figures, the cam 21 can be located adjacent a depressed portion 13A of pressure plate 13 during normal sewing machine operation and in this position shaft 5 and cam wheel 19 are free to rotate with shaft 5 as the sewing machine is in operation. In FIG. 6B pressure has been applied through inlet 8C to chamber 8B so that plunger 9 has moved upwardly against the force of spring 7A whereby shaft 7 urges pressure plate 13 and gear rack 14 to rotate shaft 5 after operation of the machine has stopped. Cam 21 has rotated in the direction shown by arrow B so after a selected arc of rotation the cam engages pressure plate 13 to stop the movement of shaft 7 and the rotation of shaft 5 at the selected position either with the needle in or out of the material being processed. It will be understood that the stop cam 21 and the clutch 20 are selectively positioned on shaft 5 and clutch 20, respectively, so that when cam 21 engages pressure plate 13 needle 2 is either in work table 3 or out of work table 3 depending upon the selected mode of operation.

One feature of the present invention is that the device within the scope of the present invention can be initially adjusted to position the needle above the work table for a period of time and then in response to changed conditions subsequently readjusted it so that the needle is within the work table after rack 14 has been exercised.

Upon release of pressure from chamber 8B, double action plunger 9 returns to the position shown in FIG. 5 and rack 14 return to the position shown in FIG. 6A so that normal operation of the sewing machine can proceed.

FIG. 5 illustrates another feature of the present invention to accommodate, automatically, selected operations used in conjunction with the machine such as thread cutoff, foot pedal lift etc. in FIG. 5 a valve assembly 60 is shown in cross section where a casing 61 is shown defining a chamber 62 which receives a piston 65 carried by a shaft 66. A pressurized fluid inlet 63 is provided and a fluid outlet 64 is also provided so that when piston 65 moves within casing 61 to uncover outlet 64 the fluid supplied to inlet 63 preferably from the same fluid source used to operate cylinder 8, also supplied through the outlet 64 to an auxiliary device so the two operate in unison. When cylinder 60 is actuated, fluid is emitted from outlet 64 to the device to be operated thereby (not shown) such as a thread cutoff. A spring 67 is provided in casing 61 to urge piston 65 toward inlet 63 and to cover outlet 64. As shown shaft 66 is normally urged against wheel 19 by the pressure of the fluid supplied to inlet 63 so when the machine is operating shaft 66 cannot move to allow flow of fluid from outlet 64. However, as shown in FIG. 8 wheel 19 includes a groove 68 so that when wheel 19 has been rotated to the position shown in FIG. 6B shaft 66 is received in groove 68 so piston 65 is extended and outlet 64 uncovered to operate the auxiliary device. When normal operation resumes so that pressure is relieved from cylinder 8 the pressure is also relieved from cylinder 60 so the spring 67 returns piston 65 to a position to cut off outlet 64.

Figure 7:
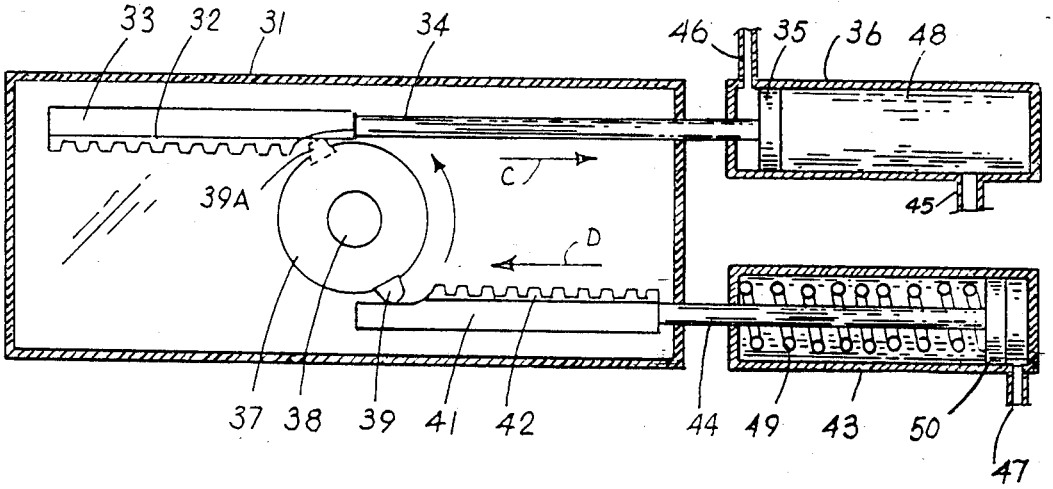
FIG. 7 is a side view of an arrangement within the scope of the present invention to provide dual positioning at opposite ends of a needle stroke.

FIG. 7 is an illustration of an arrangement within the scope of the present invention, which provides the facility to selectively position the needle both in and out of the work piece. In FIG. 7 a casing 31 is provided having dual gear racks 33, 41 including respectively pressure plates 32,42. Rack 33 moves in the direction shown by arrow C to, for example, rotate a shaft 38 which includes a clutch assembly (not shown) which carries a cam wheel 37, similar to wheel 19 of FIG. 2, to position the needle in the work piece. A gear rack 41 having a pressure plate 42 can be adapted to be moved in the direction shown by arrow D to, for example, engage a gear wheel (not shown) on a clutch (not shown but similar to the clutch assembly of FIG. 2) to locate the needle above the work piece upon actuation of a plunger 50 carried in a casing 43. Plunger 50 is connected to gear rack 41 by means of a shaft 44 and a spring 49 is provided within casing 43 to return the plunger 50 to the relaxed position. An aperture 47 is provided to supply pressurized fluid to casing 43 for movement of plunger 50 and for emission of fluid to allow spring 49 to return gear rack 41 to the relaxed position out of engagement with wheel 37. In an example of another arrangement within the scope of the present invention. A double acting piston including a casing 36 is provided having an inlet/outlet 46 to urge a plunger 35 from a first position near inlet/outlet 46 where gear rack 33 is out of engagement with the gear wheel associated with the clutch to a second position where the plunger is urged in the direction shown by arrow C by application of pressure through inlet 46 and exhaust through inlet/outlet 45 to move gear rack 33 to rotate shaft 38 until cam 39A engages a pressure plate 32 carried in gear rack 33 (as previously described with reference to FIG. 2) where, for example the associated needle assembly could be located in the work. The piston and shaft are returned to the position shown in FIG. 7 by application of fluid pressure to inlet/outlet 45 and exhaust through inlet/outlet 46. Thus by selective application of pressurized fluid to apertures 45,46,47 the operator can assure the position of the needle in or out of the workpiece as desired.

Figure 9A:
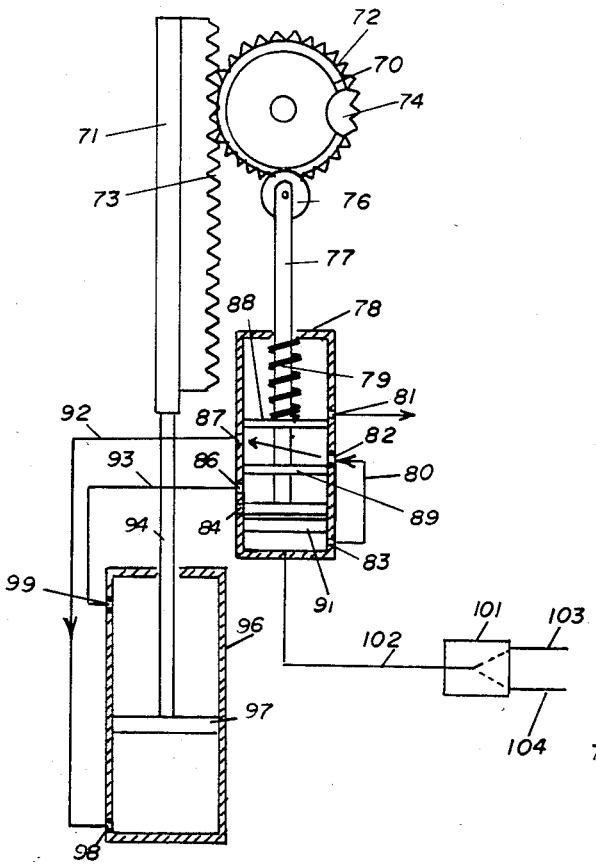
FIGS. 9A–9B illustrates schematically yet another arrangement within the scope of the present invention.
Figure 9B:
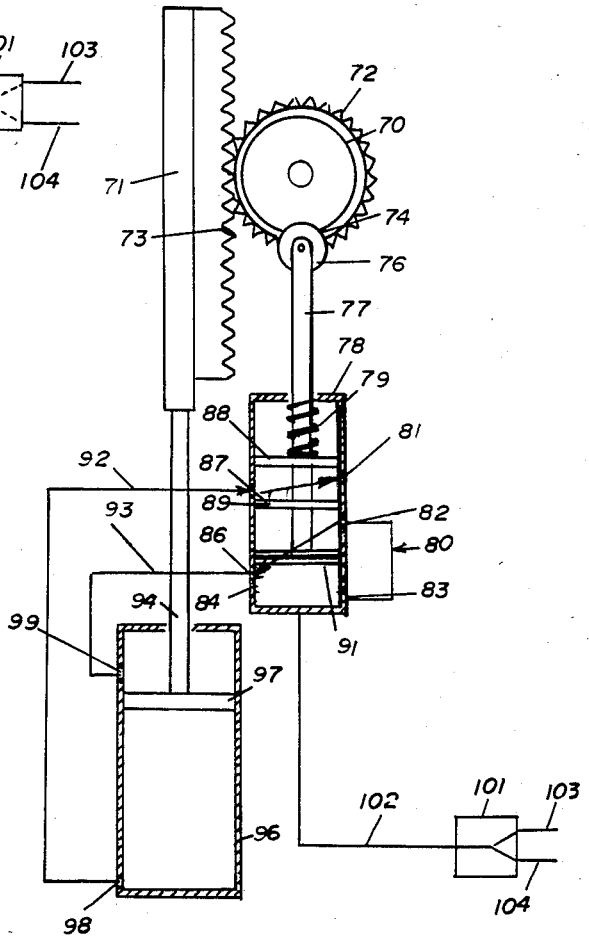

Further, within the scope of the present invention an arrangement shown in FIGS. 9A–9B provide an alternative means to accomplish the results of the invention. In FIGS. 9A–9B, a gear wheel 72 is povide similar to wheel where a clutch 70 is provided having an outer cam follower surface with a depression 74. A cam follower 76 is provided connected to a shaft 77.

A shaft 71 having a pressure plate similar to pressure plate 13 previously described is provided and carries a gear rack 73 to engage the gears of wheel 72.

The arrangements shown in FIGS. 9A and 9B provides means to relief the stress on the actuating mechanism previously described when the needle has reached the desired position.

In this regard a pilot actuated valve 78 is provided which achieves automatic resetting and further provides a signal provided by FIG. 5.

In FIG. 9A, four-way valve 78 includes a shaft 77 connected to follower 76 as previously described. A compression spring 79 is provided to surround shaft 77 in valve body 78 and piston 88, 89 and 91 are provided, as shown. Valve 78 has ports 81, 82 and 83, 84 and 85, as shown. The valve is actuated by a valve 101 which includes an inlet 104 and an exhaust 103. Valve 101 is normally in the exhaust. But when it is desired to actuate the needle to a selected position the valve is actuated causing air pressure supplied at inlet 104 to be provided through outlet 102 to the lower chamber of valve 78. This urges piston 91, which carries pistons 81, 89 upwardly as shown so that cam followers 76 engages the cam surface of clutch assembly 70. Piston 91 is moved to the position shown in FIG. 9A, air admitted to the valve assembly by means of inlet 102 is exhausted through port 83 to port 82, thence to port 87 to conduit 92 which supplies the air pressure to the bottom of a piston 97 carried in a chamber 96. Piston 97 then moves upwardly, moving shaft 94, and gear rack 73 upwardly to rotate the gear wheel 72, the gear wheel 72 is rotated until the clutch 70 has rotated to the point where the depression 74 receives follower 76, as shown in FIG. 9B. At this time, because of the continued pressure at inlet 102 piston 91 moves further up exposing port 84 but in the meantime pistons 88 and 89 have risen so that air flows from the port 82 through port 83 to the port 86 and the air pressures applied to the outlet 93 which then is applied to the upper portion of valve 96 so that piston 97 starts downward movement, allowing air to be exhausted through the conduit 92 to the port 87 thence to port 81 and exhaust. The air exhausted from the port 81 can then be used to actuate the external mechanism to actuate other devices such as threadcutters and so forth. The gear rack 73 is then retracted by movement of the piston 97 without movement of the clutch 70 returning the gear rack to its normal position and leaving the needle in the set position.

It will be understood that the foregoing are but a few examples of devices within the scope of the present invention and that various other devices also within the scope of the present invention will occur to those skilled in the art upon reading the disclosure set forth herein.

The invention claimed is:

1. A device for use with a sewing machine to position the sewing machine needle to selected location with respect to a work surface where the sewing machine includes a rotatable drive shaft for the stitching mechanism including a clutch means attached to the drive shaft to rotate the drive shaft when the clutch is rotated in a first direction where the clutch includes a stop to engage pressure plate means when the clutch has rotated in the first direction to a selected point where the needle is in selected location with respect to said work surface where the pressure plate is carried by a gear rack assembly which moves bidirectionally along a selected axis and includes a gear rack to engage a gear carried by the clutch to rotate said clutch and drive shaft in the first direction when the gear rack moves in a first direction until the stop engages the pressure plate to stop the gear rack assembly and rotates the clutch in a second direction when the gear rack moves in the second direction to release the stop from the pressure plate.

2. The invention of claim 1 including fluid operated piston means attached to said gear rack assembly to selectively move said gear rack assembly.

3. The invention of claim 2 wherein said piston means moves said gear rack assembly in said first direction and including spring bias means to move said gear rack assembly in said second direction.

4. The invention of claim 3 including second stop means on said clutch and second rack assembly means to rotate said clutch in said second direction to rotate said drive shaft and second pressure plate means to engage said second stop to terminate rotation of said drive shaft when said clutch has rotated said drive shaft to a point where said needle is in second position relative to said work surface.

5. The invention of claim 4 including fluid operated second piston means attached to said second gear rack assembly to selectively move said second gear rack assembly in said second direction.

6. The invention of claim 1 including:

(a) cam means carried by said clutch means having a cam surface and a depression therein;

(b) cam follower means to selectively engage said cam surface and to be received in said depression when said cam means has rotated to selected position;

(c) valve means having a case to define a chamber having first, second, third, fourth, fifth and sixth ports and a piston assembly including first, second and third piston means carried in spaced relation on shaft means which extends out of said case where said shaft means is moveable in a first direction in said valve means to first, second and third positions and includes bias means to move said shaft means in a second direction;

(d) actuator means to supply compressed gas to said first port of said valve means whereby said piston assembly is moved in said first direction;

(e) second piston means having a case adapted to receive rack piston means moveable in said first and second direction carrying a shaft connected to gear rack assembly means to move said gear rack assembly means in said first and second directions and having first rack piston port means and second rack piston port means, whereby, upon actuation of said actuator means compressed gas is applied to said first port to move said piston assembly from said second position where said cam follower is out of engagement with said cam surface, so said piston assembly allows compressed gas to flow from said first port to said second port, from said second port to said third port and from said third port to said fourth port, to said first rack piston port to move said rack piston means to said first position whereby said clutch means is rotated and moves said needle to said selected position until said cam surface has moved to the point where said cam follower engages said depression whereby said piston is moved by said compressed gas supplied to said first port and compressed gas admitted to said second port and to said fifth port which supplies said compressed gas to said second rack piston port to move said rack piston to said second position and to allow said compressed gas to flow from said first rack piston port to said sixth port, where, upon removal of said compressed gas from said first port, said piston assembly means is moved in said second direction to said first position by said bias means.

* * * * *